US007066400B2

(12) United States Patent
Brenk et al.

(10) Patent No.: US 7,066,400 B2
(45) Date of Patent: Jun. 27, 2006

(54) FUEL INJECTION SYSTEM FOR INTERNAL COMBUSTION ENGINES WITH NEEDLE STROKE DAMPING

(75) Inventors: Achim Brenk, Kaempfelbach (DE); Martin Kropp, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/068,956

(22) Filed: Mar. 2, 2005

(65) Prior Publication Data

US 2005/0194468 A1 Sep. 8, 2005

(30) Foreign Application Priority Data

Mar. 5, 2004 (DE) ..... 10 2004 010 760

(51) Int. Cl.
*B05B 9/00* (2006.01)
*F02M 61/20* (2006.01)
*F02M 59/46* (2006.01)

(52) U.S. Cl. ..... 239/124; 239/533.2; 239/533.9; 239/88; 123/467; 123/446

(58) Field of Classification Search ..... 239/124, 239/126, 127, 533.1–533.11, 88, 89, 92; 123/467, 446, 500, 501
See application file for complete search history.

(56) References Cited

U.S. PATENT DOCUMENTS 5,551,634 A * 9/1996 Raab et al. ..... 239/96
6,453,875 B1 * 9/2002 Mahr et al. ..... 123/446
6,491,017 B1 * 12/2002 Mahr et al. ..... 123/299
6,499,465 B1 * 12/2002 Mahr et al. ..... 123/447
6,513,497 B1 * 2/2003 Mahr et al. ..... 123/447
6,520,152 B1 * 2/2003 Mahr et al. ..... 123/447
6,532,938 B1 * 3/2003 Mahr et al. ..... 123/447
6,553,967 B1 * 4/2003 Mahr ..... 123/467
6,557,776 B1 * 5/2003 Carroll et al. ..... 239/5
6,598,811 B1 * 7/2003 Boecking ..... 239/533.8
6,619,263 B1 * 9/2003 Otterbach et al. ..... 123/447
6,655,355 B1 * 12/2003 Kropp et al. ..... 123/467
6,675,773 B1 * 1/2004 Mahr et al. ..... 123/446
6,688,277 B1 * 2/2004 Mahr et al. ..... 123/299
6,725,838 B1 * 4/2004 Shafer et al. ..... 123/446
6,769,635 B1 * 8/2004 Stewart et al. ..... 239/558
6,776,138 B1 * 8/2004 Mahr et al. ..... 123/446
6,789,743 B1 * 9/2004 Baranowski et al. ..... 239/124

(Continued)

*Primary Examiner*—Dinh Q. Nguyen
*Assistant Examiner*—Seth Barney
(74) *Attorney, Agent, or Firm*—Ronald E. Greigg

(57) ABSTRACT

A fuel injection system for internal combustion engines with a fuel injector that can be supplied from a high-pressure fuel source has an injection valve, with injection nozzles pointing toward the combustion chamber, and coaxial inner and outer nozzle needles assigned to the injection nozzles are triggerable as a function of pressure to open and close various injection cross sections at the injection nozzles. Each of the nozzle needless is assigned a respective damping piston, and the damping pistons are movable relative to one another and act on a damping chamber which can be made to communicate with a low-pressure return system via an outlet throttle. In addition to the damping chamber, a closing chamber is provided, to which an end face of the outer nozzle needle is exposed in the closing direction. The closing chamber can be made to communicate with the low-pressure return system as well, via a closing chamber throttle; the outlet throttle has a greater throttling action than the closing chamber throttle, so that the pressure in the closing chamber drops first, and only after a delay does the pressure in the damping chamber drop as well.

20 Claims, 7 Drawing Sheets

U.S. PATENT DOCUMENTS 6,810,856 B1 * 11/2004 Magel ..... 123/446
6,810,857 B1 * 11/2004 Boehland et al. ..... 123/467
6,814,057 B1 * 11/2004 Mahr et al. ..... 123/446
2003/0089802 A1 * 5/2003 Mahr et al. ..... 239/533.2
2003/0131824 A1 * 7/2003 Mahr et al. ..... 123/446
2004/0011882 A1 * 1/2004 Boehland et al. ..... 239/88
2004/0149265 A1 * 8/2004 Magel et al. ..... 123/446
2005/0224600 A1 * 10/2005 Brenk et al. ..... 239/88

* cited by examiner

FUEL INJECTION SYSTEM FOR INTERNAL COMBUSTION ENGINES WITH NEEDLE STROKE DAMPING

BACKGROUND OF THE INVENTION

1. Field of the Invention

The invention relates to an improved fuel injection system for internal combustion engines.

2. Description of the Prior Art

A fuel injector with two rows of injection nozzles in the form of holes, to each of which an inner nozzle needle and coaxial to it an outer nozzle needle are assigned, is known for instance from German Patent Disclosure DE 102 05 970 A1. Such injection nozzles, which when triggered as a function of pressure open various injection cross sections, are also known as Vario nozzles. The outer and inner nozzle needles are each assigned a respective control piston, and each of these pistons acts on a fuel-filled hydraulic chamber, so that the hydraulic chambers act as actively connected control chambers. The two control chambers communicate hydraulically with one another via a connecting conduit. The control chamber of the outer nozzle needle can be made to communicate with a low-pressure return system via an outlet throttle. The connecting conduit is dimensioned such that upon opening of the outlet throttle, first the pressure in the control chamber of the outer nozzle needle drops, and only after a delay does the pressure in the control chamber of the inner nozzle needle drop.

To increase the injection pressure, which is above the pressure level of the pressure reservoir (common rail), German Patent Disclosure DE 103 29 417 A1 discloses a fuel injection system with a pressure booster device, in which to improve the injection characteristic in addition and to increase the efficiency, a Vario nozzle is likewise employed. The Vario nozzle has two coaxially disposed nozzle needles. The opening pressure of the inner nozzle needle is set either to a constant level with spring support, or to a defined ratio between the rail pressure and the opening pressure with the aid of an additional assisting pressure. As a result, it is possible to adapt the hydraulic flow through the fuel injector to the load point of the engine. The inner nozzle needle is set such that it opens only at relatively high pressures, for instance of greater than 1500 bar, in order to achieve good emissions values in the partial load state of the engine. The setting of the constant opening pressure for the inner nozzle needle is very vulnerable to tolerances, since an abrupt change in the injection quantity occurs upon the opening of the inner nozzle needle. To this extent, variations from one manufactured item to another make themselves especially unpleasantly felt. In the other variant of attaining the opening pressure of the inner nozzle needle via the constant ratio between the assisting pressure and the nozzle pressure also opens the inner nozzle needle even at partial load of the engine.

To prevent the effects of variations in the triggering duration of the control valve on the injection quantity in fuel injection systems with a pressure booster, it has already been proposed in German Patent Disclosure DE 102 29 415.1 that the opening speed of a single nozzle needle be damped, without impairing fast closure of the nozzle needle. A damping piston that defines a damping chamber and that communicates with the closing chamber of the nozzle needle via an overflow conduit is located, axially guided, in the closing chamber of the nozzle needle.

OBJECT AND SUMMARY OF THE INVENTION

The fuel injection system of the invention has the advantage that the opening speed of the inner nozzle needle and thus the injection rate can be adapted. The inner nozzle needle of the Vario nozzle can be switched actively or passively, so that the nozzle opening pressure of the inner nozzle needle can be set in such a way that it does not open until there is a demand for it in the full-load range. As a result, improved capability at extremely small quantities and a shallow injection quantity performance graph for fuel injectors with a Vario nozzle can be attained, so that further improvement in terms of emissions and noise is attained. To this extent, with the goal of reducing noise without using preinjection, an adapted injection rate course is possible over wide load ranges, even at extremely high-pressure injection systems with pressures over 2000 bar.

By means of the characteristics of the invention, according to which the outer nozzle needle is additionally exposed with a pressure face to a closing chamber, and the outlet throttle communicating with the damping chamber has a greater throttling action, pressure ratios in the damping chamber and in the closing chamber are attained that cause the pressure to drop in the closing chamber first and that allow the pressure in the damping chamber also to drop only after a delay. As a result, the outer nozzle needle opens first, and only after the action of the outer nozzle needle, via the outer damping piston on the associated damping chamber, does the inner nozzle needle lift away.

An effective pressure-dependent control of the opening of the outer and inner nozzle needles as a function of the pressures prevailing in the damping chamber and in the closing chamber is attained if the pressure face of the outer nozzle needle, acting in the closing direction, is embodied between the outer damping piston and the nozzle needle and points into a dividing line embodied between the damping piston and the outer nozzle needle. It is especially expedient if the damping chamber communicates with the closing chamber via a hydraulic connection, and the hydraulic connection is formed by a connecting conduit, embodied between an outer damping piston assigned to the outer nozzle needle and an inner damping piston assigned to the inner nozzle needle, and by a dividing line, embodied between the end faces on the side toward the nozzle needle of the outer damping piston and the end face toward the damping piston of the outer nozzle needle. As a result, fast closure of the inner nozzle needle is made possible, and the inner nozzle needle closes approximately simultaneously with the outer nozzle needle. To reinforce the closing action of the inner nozzle needle, it is expedient if this needle has an additional pressure face in the closing chamber that acts in the closing direction. By means of an additional rail-pressure-dependent relief of the inner damping piston via a separate, inner damping chamber, the closing forces of the inner nozzle needle are added together in such a way that opening takes place only above a settable rail pressure.

A further embodiment, which requires no rail pressure reinforcement, provides that a separate damping chamber for the inner nozzle needle is filled with the aid of a control line and a throttle. When an opening pressure of 1000 bar, for instance, is attained, a check valve opens, and the inner nozzle needle can open as a function of the pressure in the damping chamber. The throttle must be designed such that the relief of the inner damping chamber, during the injection at rail pressure of less than 1000 bar, does not lead to an unwanted opening of the inner nozzle needle. The inertia of the check valve is adapted to the injection duration so that the check valve, after the pressure drops below the nominal opening pressure, remains open long enough to activate the inner nozzle needle.

In a further embodiment, which also requires no rail pressure reinforcement, the damping chamber is controlled by means of a combination of two check valves. The first check valve here has a substantially higher opening pressure than the second check valve.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
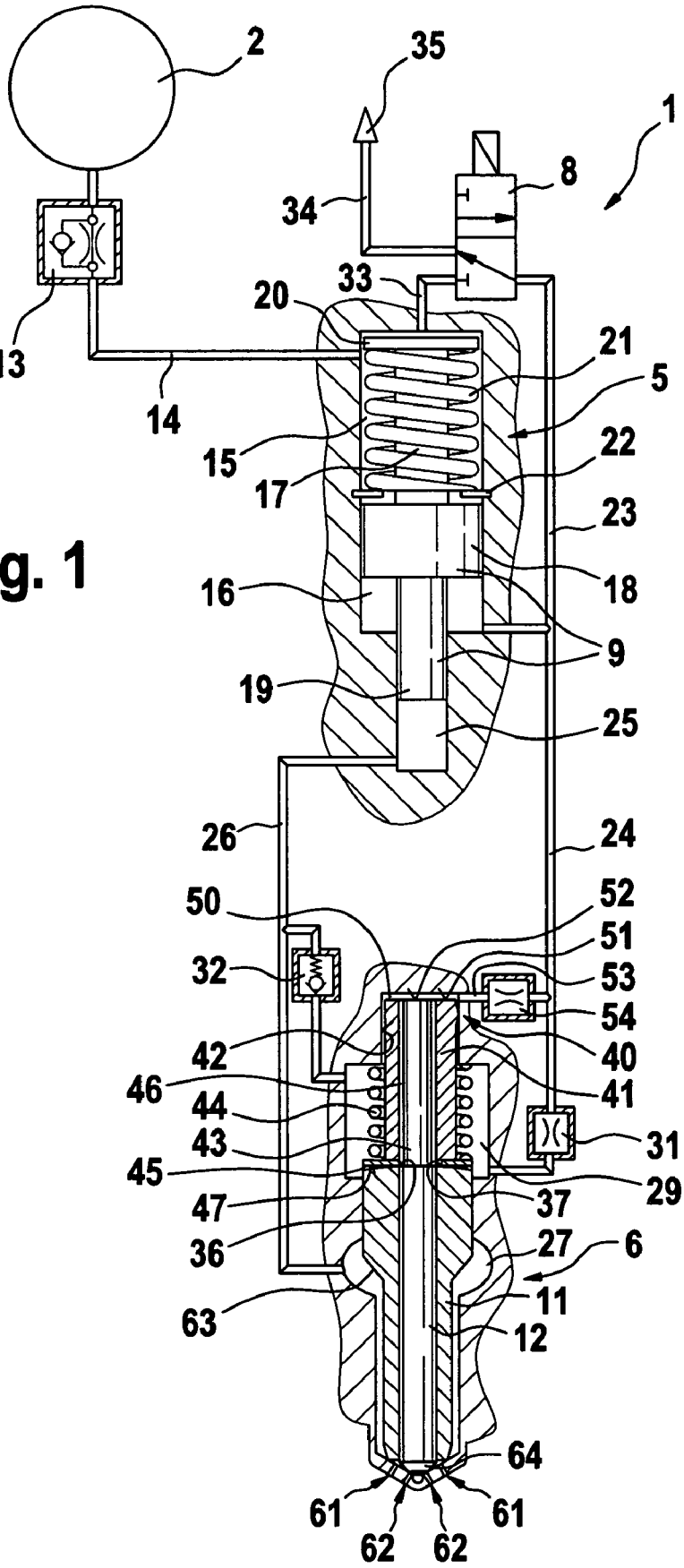
FIG. 1 is a basic illustration of a fuel injection system of the invention, in a first exemplary embodiment.

The fuel injection system shown in FIGS. 1 through 6 includes a fuel injector 1 and a high-pressure reservoir 2 (common rail); the fuel injector 1 is supplied with fuel that is at high pressure via the common rail 2. The fuel injector 1 includes a pressure booster 5, a control valve 8, and an injection valve 6, by way of which injection valve, fuel is injected into a combustion chamber, not shown, of an internal combustion engine, on the end toward the combustion chamber. The control valve 8, embodied for instance as a 3/2-way valve, is actuated by an electromagnet, in the exemplary embodiments described herein. However, it is also possible to actuate the control valve 8 by means of a piezoelectric actuator.

The injection valve 6 has a coaxial nozzle needle, with an outer nozzle needle 11 and an inner nozzle needle 12. The nozzle needles 11, 12 are guided, resting one inside the other, and are actuatable independently of one another. The injection valve 6 furthermore has two rows of injection nozzles; outer injection nozzles 61 are assigned to the outer nozzle needle 11, and inner injection nozzles 62 are assigned to the inner nozzle needle 12. The outer nozzle needle 11 has a pressure shoulder 63, inside a nozzle chamber 27. Toward the combustion chamber, the inner nozzle needle 12 is embodied with a pressure face 64, which is located upstream of the inner injection nozzles 62. Located on the side facing away from the combustion chamber is a closing chamber 29, in which the outer nozzle needle 11 rests, with an end face 37 acting in the closing direction and located toward a damping piston. The coaxial nozzle needle is assigned a damping device 40, which will be described in further detail in conjunction with the individual exemplary embodiments.

From the common rail 2, represented schematically, fuel passes via a combined check valve/throttle valve 13 and a rail pressure line 14 into a pressure chamber 15 of the pressure booster 5. Besides the pressure chamber 15 already mentioned, the pressure booster 5 includes a differential pressure chamber 16 and a high-pressure chamber 25. Inside the pressure booster 5, an axially displaceable stepped piston 9 is received, which includes a first partial piston 18 that is embodied with a larger-diameter, enabling guidance, in comparison to a second partial piston 19. The stepped piston 9 may be made of two separate components or be manufactured as a single component. The stepped piston 9 furthermore has a piston rod 17, protruding into the pressure chamber 15, with a spring holder 20 for a restoring spring 21, which rests, in the opposite direction from the spring holder 20, against a disk 22. The second partial piston 19, with its end face, defines the high-pressure chamber 25, to which a high-pressure line 26 is connected that subjects the nozzle chamber 27 of the injection valve 6 to fuel that is at very high pressure.

From the differential pressure chamber 16 of the pressure booster 5, a first line 23 and a second line 24 branch off; the first line 23 leads to a connection of the control valve 8, and the second line 24 leads, via a closing chamber throttle 31, into the closing chamber 29 of the injection valve 6. The closing chamber 29 is moreover connected to the high-pressure line 26 via a check valve 32.

The second connection of the control valve 8 communicates with the pressure chamber 15 of the pressure booster 5, via a control line 33. The third connection of the control valve 8 is connected to a return line 34, which leads into a low-pressure return system 35.

Figure 2:
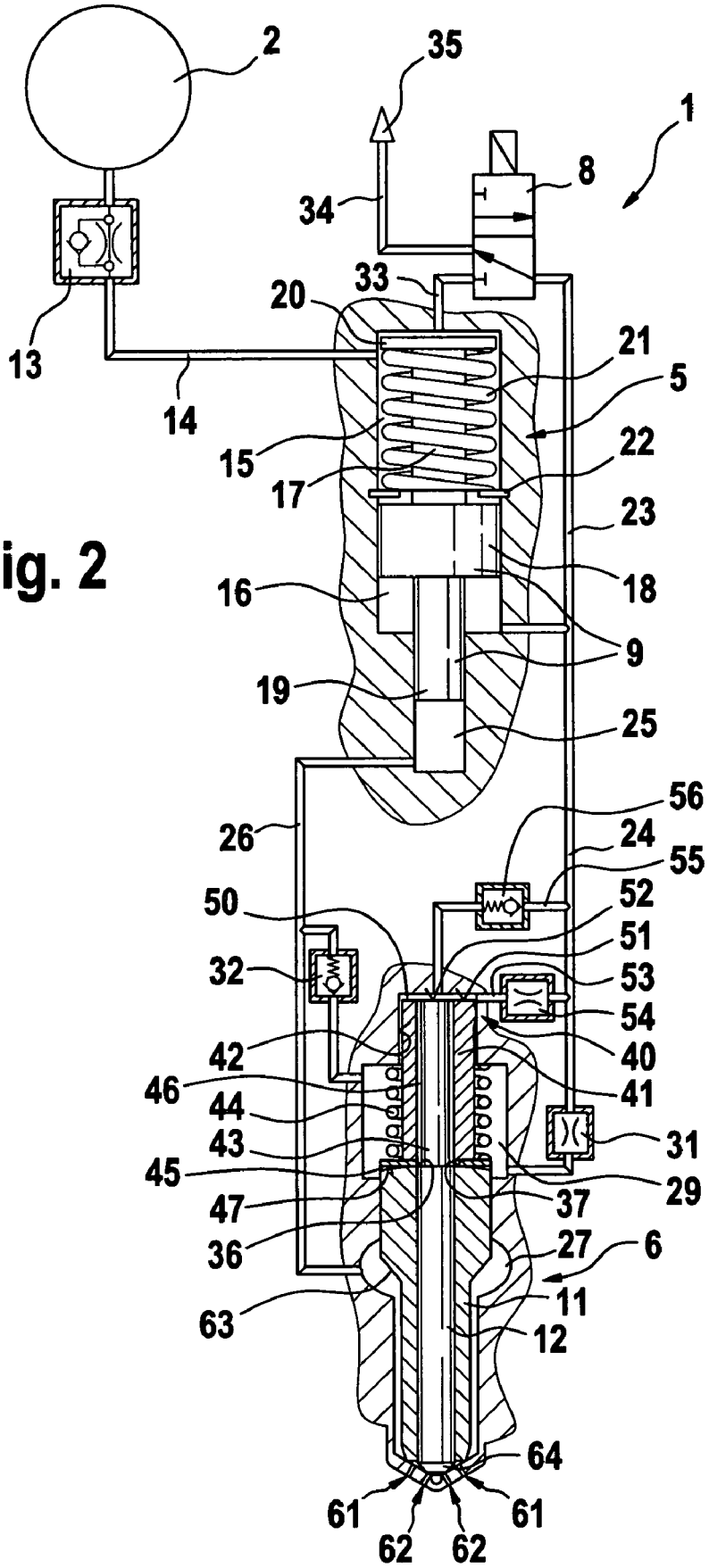
FIG. 2 shows the exemplary embodiment of FIG. 1 in a modified embodiment.

In the exemplary embodiment shown in FIGS. 1 and 2, the damping device 40 has a first, outer damping piston 41, which is guided in a bore 42 adjoining the closing chamber 29, and a second, inner damping piston 43, which in the form of a piston rod is passed through the first damping piston 41. The outer damping piston 41 is prestressed by means of a compression spring 44 in the closing chamber 29 and inside the closing chamber 29, it has an end face 47, on the side toward the nozzle needle, that rests on the end face 37, on the side toward the damping piston, of the outer nozzle needle 11. Between the end face 47 on the side toward the nozzle needle and the end face 37 on the side toward the damping piston, a dividing line 45 is embodied. The outer damping piston 41 furthermore has an annular end face 51. The inner damping piston 43 has a circular end face 52 and is operatively connected to the inner nozzle needle 12; the inner damping piston 43 can be produced either in one piece or in two pieces with the inner nozzle needle 12. The annular end face 51 of the outer damping piston 41 and the circular end face 52 of the inner damping piston 43 each point into a damping chamber 50. Between the inner damping piston 43 and the inner cylindrical wall of the outer damping piston 41, a flow conduit 46 in the form of an annular gap is embodied, which leads from the damping chamber 50 to the dividing line 45. The damping chamber 50 is connected to the second line 24 via a line 53 with an outlet throttle 54.

For reinforcing the inner nozzle needle 12, a further pressure face 36 is embodied on the inner damping piston 43 and acts for instance in the closing direction inside the flow conduit 46. Thus the opening of the inner nozzle needle 12 is dependent both on the pressure in the closing chamber 29 and on the pressure inside the common damping chamber 50.

In a basic state, in which the nozzles 61, 62 of the outer and inner nozzle needles 11, 12 are closed, all the pressure chambers in the pressure booster 5 are subjected to rail or system pressure. The stepped piston 9 is in pressure equilibrium. In this state, the pressure booster 5 is deactivated;

the stepped piston 9 has been restored to its outset position via the restoring spring 21, in the process the pressure chamber 15 has been filled via the check valve 13. In the basic state, rail pressure also prevails in the closing chamber 29 and in the damping chamber 50. Because of the ratios of the areas of the end faces 51, 52 and the pressure faces 63, 64, a hydraulic closing force acts on the inner and outer nozzle needles 11, 12. The compression spring 44 acting on the outer damping piston 41 and thus on the outer nozzle needle 11 moreover reinforces the closing process. As a consequence, the rail pressure can prevail constantly in the nozzle chamber 27 without the outer nozzle needle 11 coming open.

To bring about opening of the outer nozzle needle 11, the pressure in the nozzle chamber 27 must increase above the rail pressure; this is attained by switching on the pressure booster 5. As shown in FIGS. 1 through 7, this is initiated by a pressure relief of the differential pressure chamber 16 of the pressure booster 5, by putting the control valve 8 into the switching position shown by means of activating the electromagnet. As a result, the differential pressure chamber 16 is disconnected from the rail pressure or from the system pressure supply and is made to communicate with the return line 34 and thus with the low-pressure return system 35. The pressure in the differential pressure chamber 16 drops, and as a result the pressure booster 5 is activated, and in the process the stepped piston 9, with the partial piston 19, compresses the fuel located in the high-pressure chamber 25. The compressed fuel is carried into the nozzle chamber 27 via the high-pressure line 26. Simultaneously, the closing chamber 29 is relieved via the closing chamber throttle 31, so that by the action of the high pressure on the pressure shoulder 63, the outer nozzle needle 11 is lifted and as a result the injection begins via the outer injection nozzles 61. By means of the resultant upward motion of the outer nozzle needle 11, a volume in the damping chamber 50 is compressed by the end face 51 of the first damping piston 41, and the compressed fuel can flow out of the damping chamber 50 via the outlet throttle 54 into the relieved line 24. The outlet throttle 54 has a greater throttling action than the closing chamber throttle 31, so that the damping action of the outer damping piston 41 in the damping chamber 50 can come about. By suitable dimensioning of the outlet throttle 54, the opening speed of the outer nozzle needle 11 and thus the injection rate can be adapted. After the outer nozzle needle 11 has lifted and the outer injection nozzles 61 have been uncovered, the pressure in the nozzle chamber 27 also acts on the pressure face 64 of the inner nozzle needle 12. Because of the pressure acting on the end face 52 in the damping chamber 50 and the pressure acting on the pressure face 64 of the nozzle needle 12, a resultant closing force becomes operative that opens the inner nozzle needle 12. The instant of opening of the inner nozzle needle 12 can be varied by way adapting the area of the end face 52 via the diameter of the inner damping piston 43 and the flow through the outlet throttle 54. The end face 52 of the inner damping piston 43 is expediently dimensioned such that the inner nozzle needle 12 opens when the maximum stroke of the outer nozzle needle 11 is attained. By means of this adaptation, the inner nozzle needle 12 opens passively over a wide rail pressure range, including partial load, by reaching the stroke stop of the outer nozzle needle 11.

The closing process of the Vario nozzle is initiated by a further switching of the control valve 8 thereby subjecting the control line 33 to pressure; as a result, via the lines 23, 24, the differential pressure chamber 16 and the closing chamber 29 are again subjected to the rail pressure or system pressure. The closure of the outer injection nozzles 61 is effected by filling of the closing chamber 29 and by means of the pressure applied there, which acts via the dividing line 45 upon the end face 37, toward the damping piston and acting in the closing direction, of the outer nozzle needle 11, as well as with reinforcement from the compression spring 44 acting on the outer damping piston 41. Because the throttling action of the outlet throttle 54 is greater than the throttling action of the closing chamber throttle 31, a pressure difference occurs between the closing chamber 29 and the damping chamber 50. Because of the pressure difference, a force first acts via the dividing line 45 upon the end face 37, toward the damping piston and acting in the closing direction, of the outer nozzle needle 11. Simultaneously, by the uncovering of the dividing line 45, fuel is introduced substantially unthrottled into the damping chamber 50 by way of the hydraulic connection of the dividing line 45 and the flow conduit 46, so that given the pressures on the end face 52 and the pressure face 64, a resultant closing force also acts on the inner nozzle needle 12, and this force moves this needle downward to close the inner injection nozzles 62. As a result, a fast closure of the inner nozzle needle 12 that ensues simultaneously with the closure of the outer nozzle needle 11, is attained.

Figure 7:
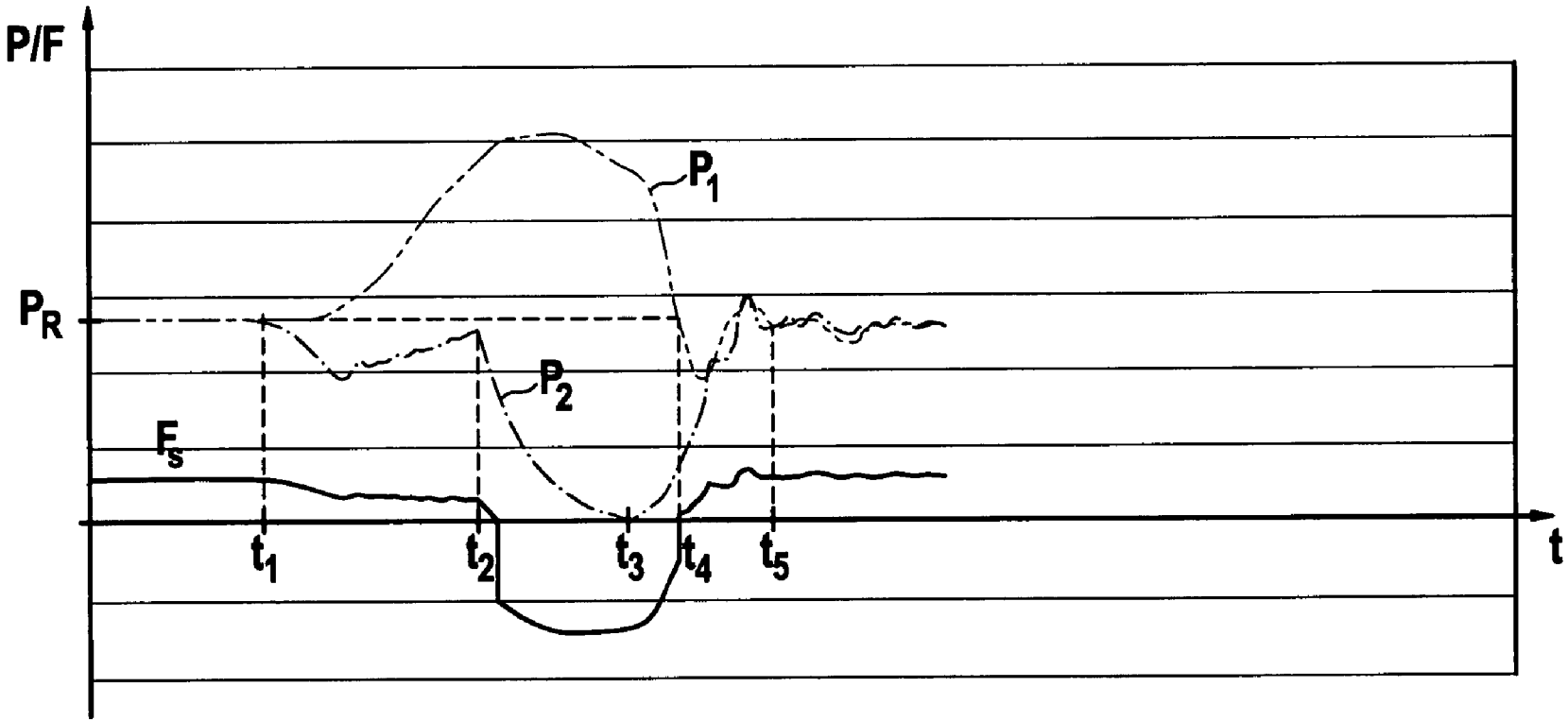
FIG. 7 is a graph illustrating the pressure courses of the fuel injector in FIG. 1.

The sequence of the motions of the nozzle needles 11 and 12 and of the pressure at the pressure faces of the nozzle needles 11, 12 and in the damping chamber 50, as well as the resultant closing force for the inner nozzle needle 12, will be explained below in terms of the force and pressure courses shown in FIG. 7; the nozzle pressure at the pressure faces of the nozzle needles 11, 12 are designated by $P_1$, the damper pressure in the damping chamber 50 by $P_2$, and the closing force on the inner nozzle needle 12, resulting from the pressure forces acting on the pressure face 64 and the end face 52 of the inner nozzle needle 12, by $F_s$. Initially, the nozzle pressure $P_1$ and the damper pressure $P_2$ have the value of the rail pressure $P_R$, for instance 1350 bar. The closing force $F_s$, as the resultant force between the pressure forces at the pressure face 64 and at the end face 52, is positive until this point. The time $t_1$ represents the switching time of the control valve 8 at which the control valve 8 initiates a pressure relief of the differential pressure chamber 16 of the pressure booster 5 by means of the switching position shown in FIG. 1. With somewhat of a delay, because of the motion of the step piston 9, a compression of the fuel in the high-pressure chamber 25 begins, so that the nozzle pressure $P_1$ rises, and as a result the outer nozzle needle 11 lifts, and injection occurs via the outer injection nozzles 61. Simultaneously, the outer damping piston 41 is moved in the direction of the damping chamber 50, which initially causes a slight pressure increase in the damper pressure $P_2$, until a time $t_2$. The slight drop in the closing force $F_s$ on the inner nozzle needle 12 is due to the fact that, because of the opening of the outer nozzle needle 11 and the pressure increase in the damping chamber 50, initially only a slight displacement of forces ensues at the inner nozzle needle 12. At time $t_2$, the outer nozzle needle 11 and thus the outer damping piston 41 are at the upper end stop, and the pressure $P_2$ in the damping chamber 50 drops sharply thereafter. Simultaneously, the closing force $F_s$ acting on the inner nozzle needle 12 abruptly drops to below zero; that is, the force acting on the pressure face 64 exceeds the force acting on the end face 52. The result is opening of the inner nozzle needle 12, shortly after $t_2$. The time $t_3$ is the second switching time of the control valve 8, which concludes the relief of the line 23 via the return line 24, so that the buildup of a pressure-balanced system now begins. At time $t_3$, rail or system pressure is again built up in the closing chamber 29 via the closing chamber throttle 31 and also in the damping chamber 50 via the outlet throttle 54, the dividing line 45, and the flow conduit 46. Simultaneously, the stepped piston 9 is put in its outset position by the restoring spring 21. The pressure $P_2$ in the damping chamber 50 thus rises again, and simultaneously the force component on the end face 52 increases and the closing force $F_s$ also rises, so that at the zero crossover, a positive closing force $F_s$ again acts on the inner nozzle needle 12, and the inner injection nozzles 62 are closed at time $t_4$. Because of the reinforcement of the compression spring 44, at the same instant, the outer nozzle needle 11 has closed the outer injection nozzles 61. Simultaneously, the course of the nozzle pressure $P_1$ has reached the rail pressure $P_R$ of 1350 bar again, at time $t_4$. The swing downward in the nozzle pressure $P_1$ is tripped by the brief decompression of the pressure chamber 25 by the restoring motion of the stepped piston 9. Shortly after that, at time $t_5$, the steady state is attained; the system is in pressure equilibrium, and the injection nozzles 61, 62 are closed. A new opening event of the injection nozzles 61, 62 ensues with the next triggering of the control valve 8.

FIG. 2 shows a refined embodiment of the exemplary embodiment of FIG. 1; in addition to the outlet throttle 54, a filling line 55 leads into the damping chamber 50, and a check valve 56 is disposed between them, which counteracts an evacuation of the damping chamber 50 into the line 24. As a result, in the switching position for closure of the nozzle needles 11, 12, an additional path to the outlet throttle 54 for filling the damping chamber 50 is created. In this embodiment, the additional filling of the damping chamber 50 via the dividing line 45 and the flow conduit 46 described in conjunction with FIG. 1 can be omitted. However, it is equally conceivable to provide both filling paths.

Figure 3:
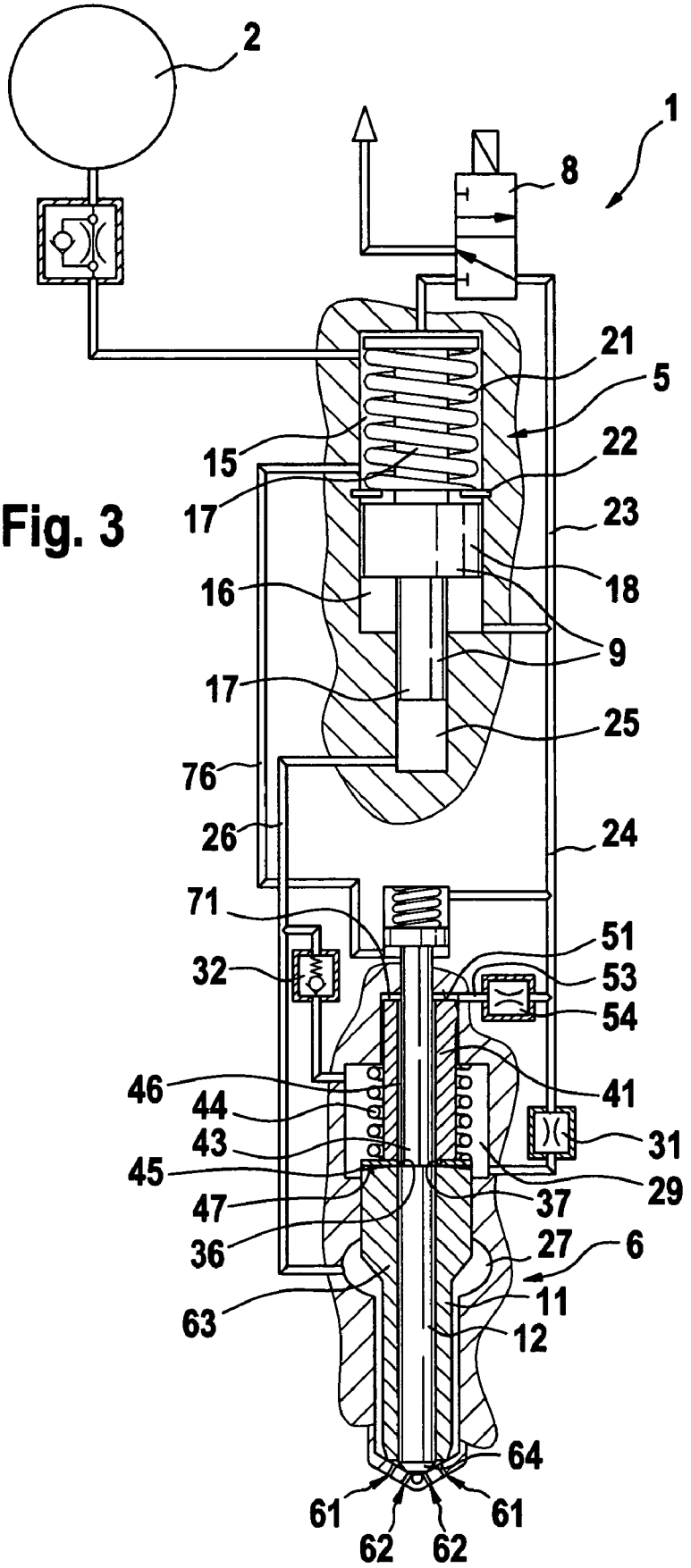
FIG. 3 is a basic illustration of a fuel injection system of the invention, in a second exemplary embodiment.

In the second exemplary embodiment shown in FIG. 3, each damping piston 41, 43 is assigned a separate damping chamber. The outer damping piston 41 points into a first damping chamber 71. The inner damping piston 43 is formed by a control piston 70, which is guided in a cylindrical chamber 72, and the cylindrical chamber 72 has a second damping chamber 73 located above the control piston 70 and a control chamber 74 located below the control piston 70. The second damping chamber 73 is connected with a line 75 and the line 24 to the differential pressure chamber 16 of the pressure booster 5. The control chamber 74 communicates with the pressure chamber 15 of the pressure booster 5 via a further line 76 and is subjected to rail pressure. The control piston 70 has an end face 77 pointing into the second damping chamber 73. The control piston 70 has an annular face 78 pointing into the control chamber 74. Because of the control chamber subjected to rail pressure, the control piston 70 is additionally relieved as a function of rail pressure. By means of a restoring spring 79, lifting of the control piston 70 from the damping piston 43 is prevented. Simultaneously, the restoring spring 79 offers better adaptability of the opening mechanism.

This exemplary embodiment requires the additional pressure face 36, acting in the closing direction on the inner nozzle needle 12, and this pressure face is embodied as a pressure step on the inner damping piston 43. The closing force for the inner nozzle needle 12 thus results from an AND function of the force ratios at the control piston 70 and at the pressure step 36. Thus the opening of the inner nozzle needle is dependent on both the rail pressure and the pressure ratios in the damping chamber 71. Hence the opening of the inner nozzle needle 12 follows only above a rail pressure that can be set by way of the force ratios at the control piston 70. For opening the coaxial nozzle needle, first the control valve 8 is put in the switching position shown, so that the differential pressure chamber 16, closing chamber 29, first damping chamber 71 and second damping chamber 73 are pressure-relieved. Because of the pressure relief of the differential pressure chamber 16, compression the pressure chamber 25 occurs, as described for the exemplary embodiments in FIG. 1, so that a pressure increase is passed on via the high-pressure line 26 to the pressure shoulder 63 of the outer nozzle needle 11. The outer nozzle needle 11 lifts from the outer injection nozzles 61 and moves the outer damping piston 41 into the position shown. As a result of the compression of the fuel in the first damping chamber 71, damping of the outer nozzle needle 11 is effected by means of the damping piston 41. Simultaneously, via the flow conduit 46, the compressed fuel acts on the pressure step 36 of the inner nozzle needle 12, causing this needle to remain in its closing position during the opening of the outer nozzle needle 11. An opening of the inner nozzle needle 12 ensues, when the closing force acting in the closing direction on the nozzle needle 12 is less than the opening force acting on the pressure face 64. The closing force is composed of the force acting on the pressure step 36 because of the pressure in the first damping chamber 71 and the force on the control piston 70 that results from the ratio of the areas of the end face 77 and the annular face 78. Since the force at the pressure step 36 in the first damping chamber 71 is negligibly slight, the force for opening the inner nozzle needle 12 is dependent substantially on the force resulting on the control piston 70, which can be defined on the basis of the rail pressure in the control chamber 74.

For closing the coaxial nozzle needle, the control valve 8 is put into the second switching position, so that the control chamber 29, the first damping chamber 71, and the second damping chamber 73 are again subjected to rail pressure; because of the different throttling actions of the closing chamber throttle 31 and the outlet throttle 54, the closing chamber 29 is filled faster. The fuel reaching the closing chamber 29, however, also flows into the first damping chamber 71 via the dividing line 45 and the flow conduit 46, so that a corresponding pressure acts on the end face 51 of the outer damping piston 41 and on the pressure step 36 of the inner damping piston 43. Simultaneously, via the connecting line 75 and the further line 76, a state of pressure equilibrium is established in the second damping chamber 73 and in the control chamber 74. The resultant closing force for the inner nozzle needle 12 is attained via the additional pressure face 36, and the restoring spring 79 reinforces the closing action of the inner nozzle needle 12. The restoring spring 79, in a two-part version of the control piston 70 and the inner damping piston 43, also serves to avoid the creation of any gap between them or any separation of the components.

In the exemplary embodiment of FIG. 4, once again a first damping chamber 81 and a second damping chamber 82 are provided; the second damping chamber 82 acts only on the inner nozzle needle 12. The second damping chamber 82 is placed via a line 83, to which a check valve 84 oriented counter to the inflow to the damping chamber 82 is inserted, and via the line 24, in communication with the differential pressure chamber 16 of the pressure booster 5. A further throttle 85 is connected parallel to the check valve 84, and by way of it, filling of the second damping chamber 82 is effected. In this exemplary embodiment, with a separate second damping chamber 82 for the inner nozzle needle 12, no rail pressure support is therefore necessary. The opening pressure for the inner nozzle needle 12 is set via the check valve 84, so that when an opening rail pressure of 1000 bar, for instance, is reached, the check valve 84 opens, and the inner nozzle needle 12 opens as a function of the pressure in the first damping chamber 81. The throttle 85 here must be designed such that the relief of the second damping chamber 82 during the injection at rail pressure of less than 1000 bar does not lead to an unwanted opening of the inner needle. The inertia of the check valve 84 is adapted to the injection duration of the injection valve 6, so that after the pressure drops below the nominal opening pressure, the check valve 84 will remain open for long enough to activate the inner nozzle needle 12.

Figure 4:
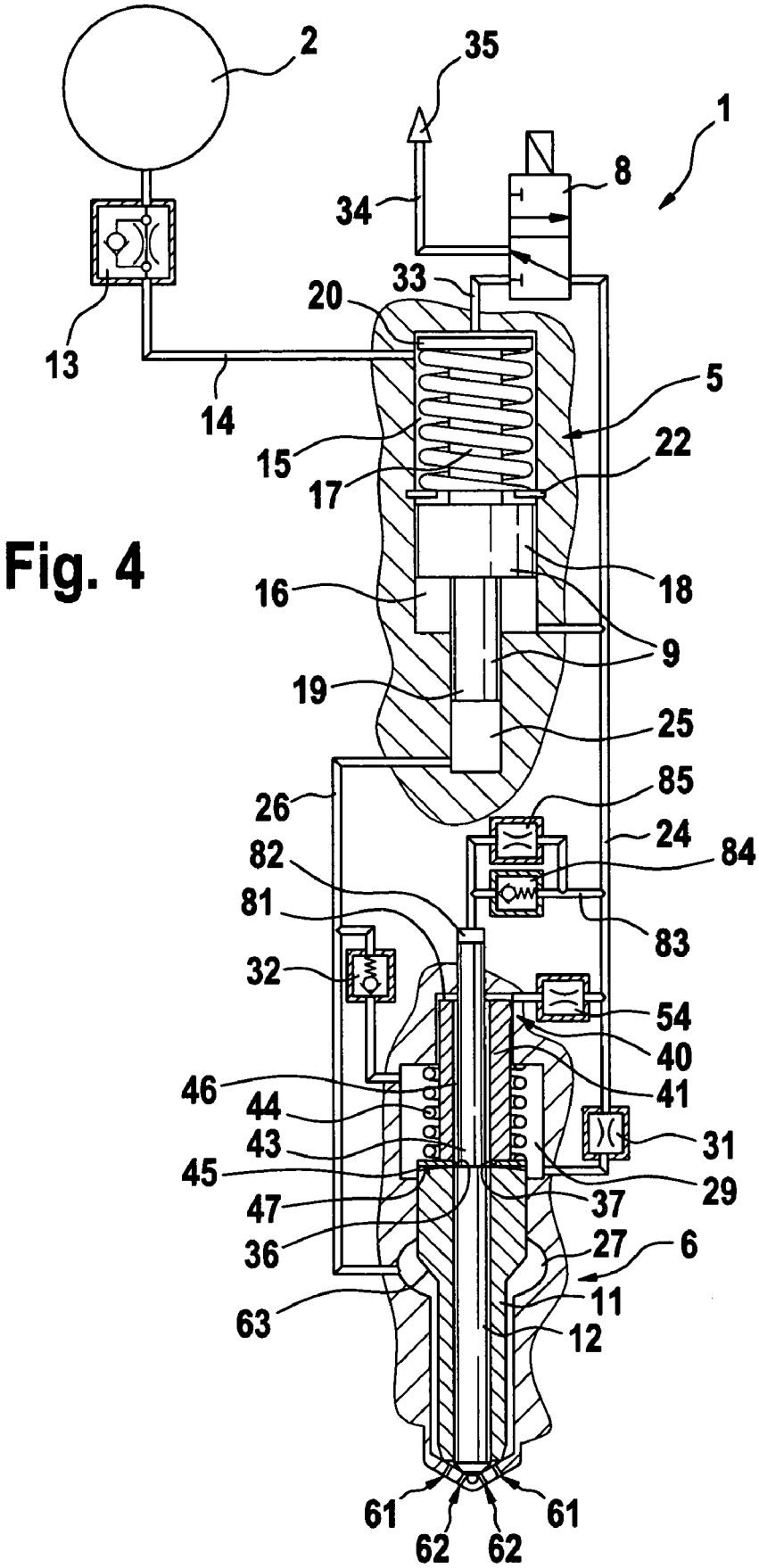
FIG. 4 is a basic illustration of a fuel injection system of the invention, in a third exemplary embodiment.
Figure 5:
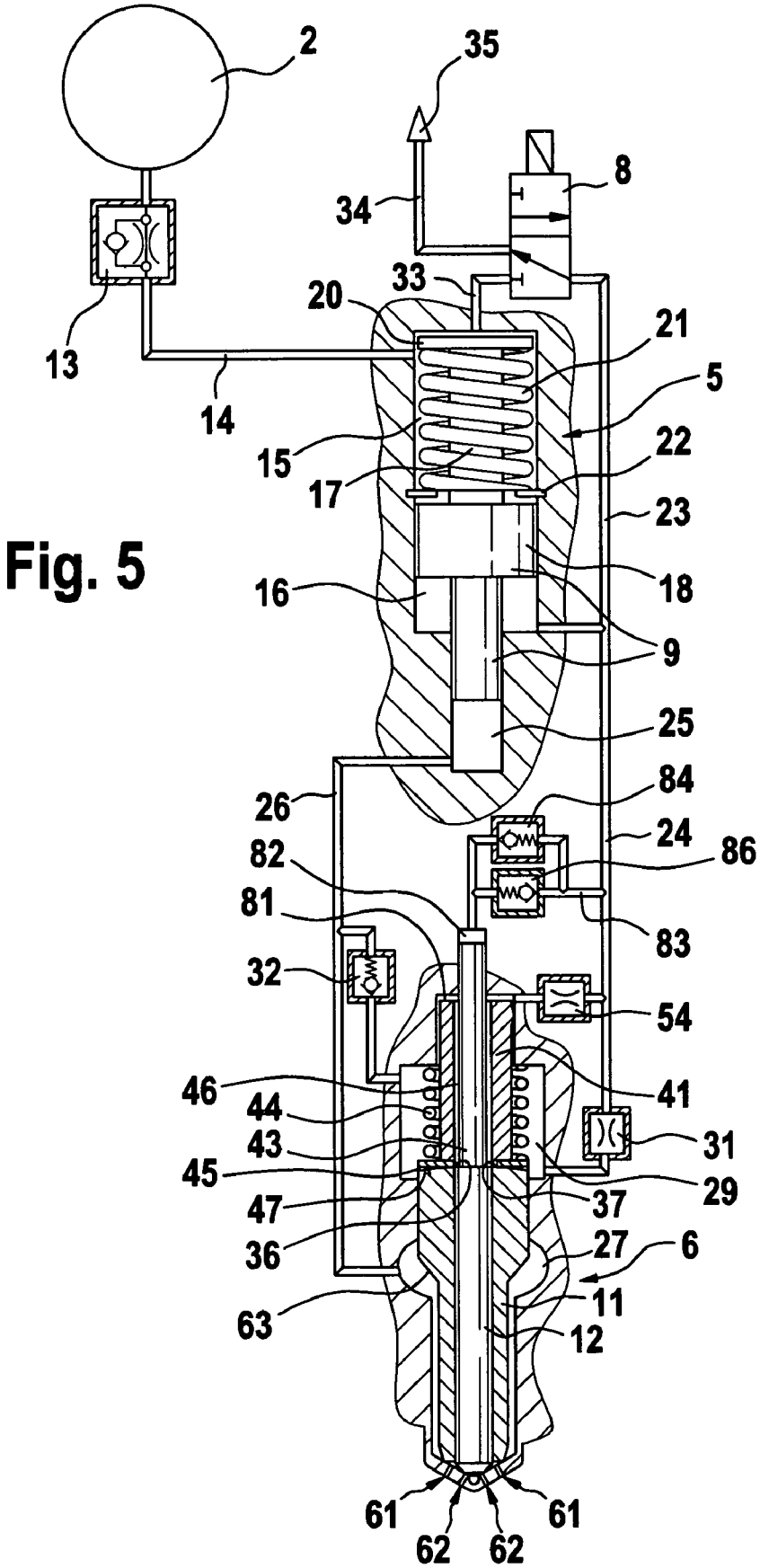
FIG. 5 shows a fuel injection system of the invention in a fourth exemplary embodiment.

In the exemplary embodiment of FIG. 5, the second damping chamber 82 likewise requires no rail pressure reinforcement. Here, the second damping chamber 82 communicates with the line 24 via a further check valve 86, instead of the throttle 85 in FIG. 4; the further check valve 86 acts in the opposite direction of the check valve 84. The check valve 84 here again has an opening pressure of approximately 1000 bar, while the further check valve 86 has an opening pressure of only about 100 bar, for instance. As a result, the second damping chamber 82 is not relieved until at a rail pressure of greater than 1000 bar, yet it refills again from about 100 bar and up, via the further check valve 86. In this exemplary embodiment as well, the inertia of the check valves 84, 86 must be suitably adapted; the further check valve 86 should have as fast a switching behavior as possible, and the check valve 84 should have a more sluggish switching behavior.

Figure 6:
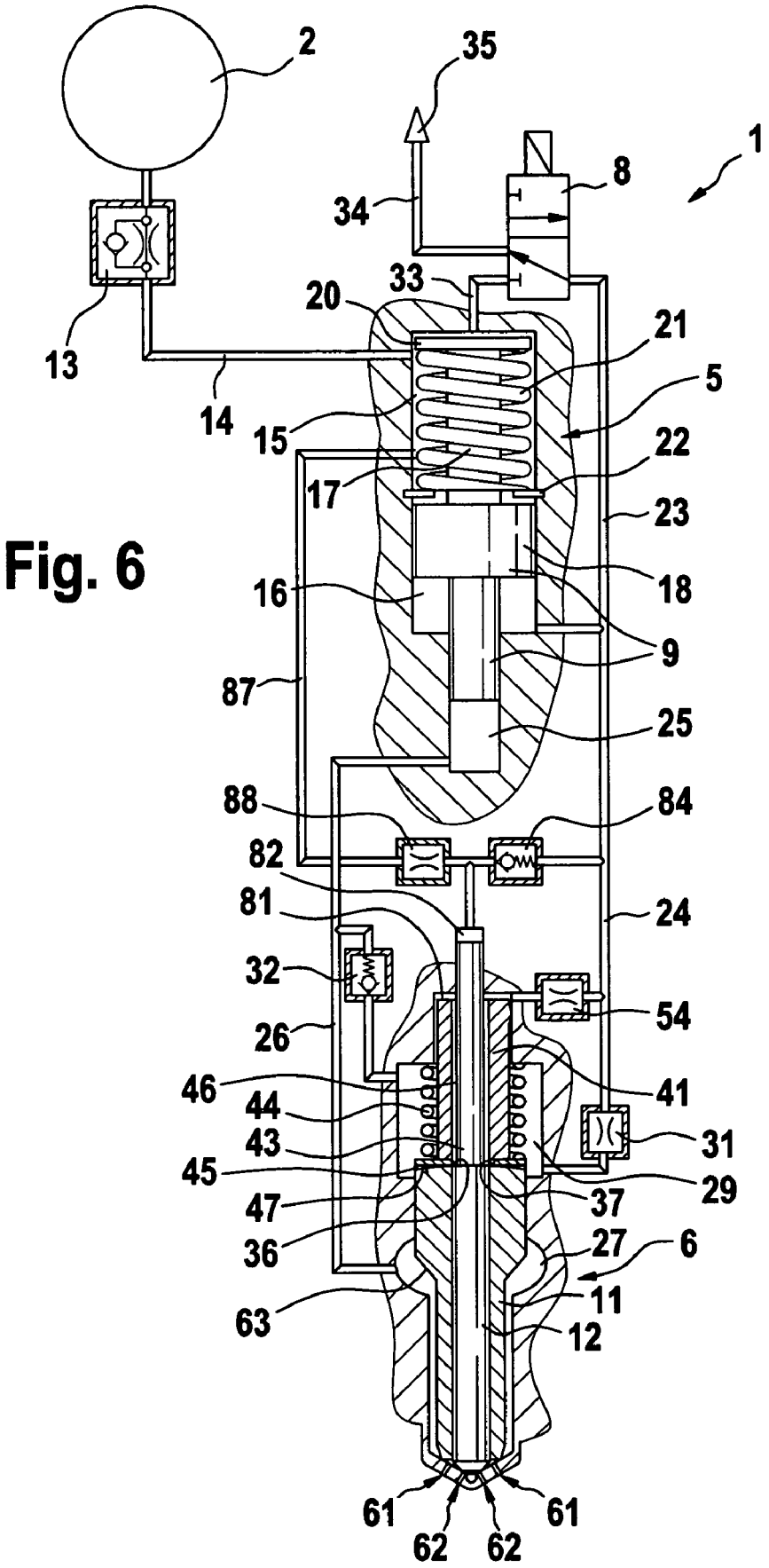
FIG. 6 shows a fuel injection system of the invention in a fifth exemplary embodiment.

FIG. 6 shows an exemplary embodiment in which the second damping chamber 82 communicates with the differential pressure chamber 16 of the pressure booster 5 via the check valve 84, as in the exemplary embodiments of FIGS. 4 and 5. Here, an additional communication of the second damping chamber 82 exists, via a line 87 leading into the pressure chamber 15 of the pressure booster 5, and a further throttle 88 is integrated with the line 87. Thus the second damping chamber 82 is coupled to rail pressure via the throttle 88. In this exemplary embodiment, an additional control quantity is necessary for the duration of the injection via the inner injection nozzles 62.

In all the exemplary embodiments, the nozzles 61, 62 and the damping chambers 50, 71, 73, 81, 82 are acted upon by pressure. To avoid leakage via the guidance between the inner nozzle needle 12 and the outer nozzle needle 11, provisions known per se should be made, such as a double nozzle needle seat at the outer nozzle needle 11, or else an additional means of leakage diversion should be provided between the nozzle needles 11, 12.

It is furthermore conceivable for the damping device 40 described in conjunction with FIGS. 1 through 7 for the coaxial nozzle needle also to be employed without a pressure booster 5. Then the line 26 leading into the high-pressure chamber 25 should be connected to rail pressure.

The foregoing relates to preferred exemplary embodiments of the invention, it being understood that other variants and embodiments thereof are possible within the spirit and scope of the invention, the latter being defined by the appended claims.

We claim:

1. In a fuel injection system for internal combustion engines, the system having a fuel injector that can be supplied from a high-pressure fuel source and that has an injection valve with injection nozzles pointing toward a combustion chamber, coaxial inner and outer nozzle needles assigned to the injection nozzles, the coaxial inner and outer nozzle needles being triggerable as a function of pressure to open and close various injection cross sections at the injection nozzles, each nozzle needle being assigned a respective damping piston, the damping pistons being movable relative to one another and acting on at least one fuel-filled chamber which communicates with a low-pressure return system via an outlet throttle, the improvement wherein the fuel-filled chamber forms a damping chamber (50, 71, 81) for the damping piston (41, 43); a closing chamber (29) to which an end face (37) of the outer nozzle needle (11) is exposed that acts in the closing direction; the closing chamber (29) communicates with the low-pressure return system (35) via a closing chamber throttle (31); and the outlet throttle (54) has a greater throttling action than the closing chamber throttle (31).

2. The fuel injection system according to claim 1, wherein the end face (37) acting in the closing direction is embodied between the damping piston (41) for the outer nozzle needle (11) and the nozzle needle (11), and wherein has a dividing line (45) embodied between the damping piston (41) and the outer nozzle needle (11).

3. The fuel injection system according to claim 1, wherein the damping chamber (50, 71, 81) assigned to the outer nozzle needle (11) communicates with the closing chamber (29) via a hydraulic connection.

4. The fuel injection system according to claim 1, wherein the damping chamber (50, 71, 81) assigned to the outer nozzle needle (11) communicates with the closing chamber (29) via a hydraulic connection.

5. The fuel injection system according to claim 3, wherein the hydraulic connection is formed by a connection (46), embodied between the outer damping piston (41), assigned to the outer nozzle needle (11), and the inner damping piston (43), assigned to the inner nozzle needle (12), and by the dividing line (45) embodied between an end face (47), on the side toward the nozzle needle, of the outer damping piston (41) and the end face (37), acting in the closing direction, of the outer nozzle needle (11).

6. The fuel injection system according to claim 1, wherein the inner damping piston (43) assigned to the inner nozzle needle (12) has an additional pressure face (36), acting in the closing direction, in the closing chamber (29).

7. The fuel injection system according to claim 1, wherein one common damping chamber (50) is provided for both damping pistons (41, 43).

8. The fuel injection system according to claim 2, wherein one common damping chamber (50) is provided for both damping pistons (41, 43).

9. The fuel injection system according to claim 3, wherein one common damping chamber (50) is provided for both damping pistons (41, 43).

10. The fuel injection system according to claim 5, wherein one common damping chamber (50) is provided for both damping pistons (41, 43).

11. The fuel injection system according to claim 7, further comprising a check valve (56) connected parallel to the outlet throttle (54) and blocking an evacuation of the damping chamber (50) and opening only in the filling direction.

12. The fuel injection system according to claim 1, wherein the at least one fuel filled chamber comprises a first damping chamber (71, 81) for the outer damping piston (41), acting on the outer nozzle needle (11), and a second damping chamber (71, 82) for the inner damping piston (43), acting on the inner nozzle needle (12).

13. The fuel injection system according to claim 2, wherein the at least one fuel filled chamber comprises a first damping chamber (71, 81) for the outer damping piston (41), acting on the outer nozzle needle (11), and a second damping chamber (71, 82) for the inner damping piston (43), acting on the inner nozzle needle (12).

14. The fuel injection system according to claim 4, wherein the at least one fuel filled chamber comprises a first damping chamber (71, 81) for the outer damping piston (41), acting on the outer nozzle needle (11), and a second damping chamber (71, 82) for the inner damping piston (43), acting on the inner nozzle needle (12).

15. The fuel injection system according to claim 5, wherein the at least one fuel filled chamber comprises a first damping chamber (71, 81) for the outer damping piston (41), acting on the outer nozzle needle (11), and a second damping chamber (71, 82) for the inner damping piston (43), acting on the inner nozzle needle (12).

16. The fuel injection system according to claim 12, wherein the inner damping piston (43) acts via a control piston (70), which is assigned a control chamber (74) with a rail-pressure-dependent relief.

17. The fuel injection system according to claim 12, wherein the second damping chamber (82) communicates with the low-pressure return system (35) via a further outlet throttle (85) and via a check valve (84) connected parallel to it, and the check valve (84) blocks the filling direction of the second damping chamber (82) and is set with the opening pressure to the opening pressure of the inner nozzle needle (12).

18. The fuel injection system according to claim 12, wherein the second damping chamber (82) communicates with the low-pressure return system (35) via two parallel-connected check valves (84, 86); and the two check valves (84, 86) block in opposite directions, and the check valve (84) that blocks the filling has an opening pressure for evacuating the second damping chamber (82) which is substantially higher than the opening pressure of the check valve (86) that blocks the evacuation and that is set to the opening pressure of the inner nozzle needle (12).

19. The fuel injection system according to claim 12, wherein the second damping chamber (82) communicates with the low-pressure return system (35) via a check valve (84) that blocks the filling, and the opening pressure of the check valve (84) is set to the opening pressure of the inner nozzle needle (12); and the second damping chamber (82) can be acted upon with rail pressure via a further throttle (88).

20. The fuel injection system according to claim 1, further comprising a pressure boosting device (5) having with a differential pressure chamber (16) which communicates with the low-pressure return system (35); the damping chamber (50, 71, 73, 81, 82) communicating with the low-pressure return system (35).

* * * * *